US008104990B2

(12) United States Patent
Lowe

(10) Patent No.: US 8,104,990 B2
(45) Date of Patent: Jan. 31, 2012

(54) PAVING SYSTEM

(76) Inventor: Timothy Robert Lowe, Leicester (GB)

( * ) Notice: Subject to any disclaimer, the term of this patent is extended or adjusted under 35 U.S.C. 154(b) by 622 days.

(21) Appl. No.: 11/814,345

(22) PCT Filed: Jan. 19, 2006

(86) PCT No.: PCT/GB2006/000198

§ 371 (c)(1),
(2), (4) Date: Jun. 27, 2008

(87) PCT Pub. No.: WO2006/077421

PCT Pub. Date: Jul. 27, 2006

(65) Prior Publication Data

US 2008/0267701 A1 Oct. 30, 2008

(30) Foreign Application Priority Data

Jan. 19, 2005 (GB) ..... 0501097.0

(51) Int. Cl.
*E01C 3/00* (2006.01)
*E01C 7/00* (2006.01)
*E01C 19/00* (2006.01)

(52) U.S. Cl. ..... 404/31; 404/17; 404/82

(58) Field of Classification Search ..... 404/17, 404/31, 82; 405/128.15, 129.15, 129.7, 302.4, 405/302.6, 265, 52, 53
See application file for complete search history.

(56) References Cited

U.S. PATENT DOCUMENTS

| | | | | |
|---|---|---|---|---|
| 3,870,422 | A * | 3/1975 | Medico, Jr. | 404/31 |
| 4,119,150 | A * | 10/1978 | Froelich | 166/276 |
| 4,523,755 | A * | 6/1985 | Turba | 472/92 |
| 5,310,280 | A * | 5/1994 | Hara | 405/38 |
| 6,071,039 | A * | 6/2000 | Ogura et al. | 404/32 |
| 6,102,613 | A * | 8/2000 | Medico et al. | 404/17 |
| 6,146,051 | A * | 11/2000 | Pratt | 404/2 |
| 6,767,160 | B2 * | 7/2004 | Sansalone | 404/17 |
| 6,966,723 | B2 * | 11/2005 | Zentner | 404/17 |
| 7,033,116 | B1 * | 4/2006 | Ward et al. | 405/229 |
| 7,168,884 | B2 * | 1/2007 | Hart | 404/29 |
| 7,621,692 | B2 * | 11/2009 | Wu | 404/17 |

FOREIGN PATENT DOCUMENTS

| | | | |
|---|---|---|---|
| FR | 2699855 | A1 * | 7/1994 |
| JP | 04180886 | A * | 6/1992 |

* cited by examiner

*Primary Examiner* — Thomas Will
*Assistant Examiner* — Abigail A Risic
(74) *Attorney, Agent, or Firm* — McDonnell Boehnen Hulbert & Berghoff LLP

(57) ABSTRACT

A paving system comprises an upper paving layer (1) permeable to liquid, and a substrate layer (7) of load bearing particulate material. Particles (10) of a non-load bearing, non-degradable porous foamed polymeric material are distributed in the interstitial spaces between particles (9) of the load bearing particulate material. The porous material may be an open celled phenolyic foam such as foamed phenol formaldehyde resin. The porous material absorbs water and also serves to retain microorganisms to break down pollutants. The system can be in fluid communication with the surrounding soil. Elements of the porous material may be used in lumps, which crumble under load into particles, which settle into the substrate layer.

34 Claims, 5 Drawing Sheets

Figure 6
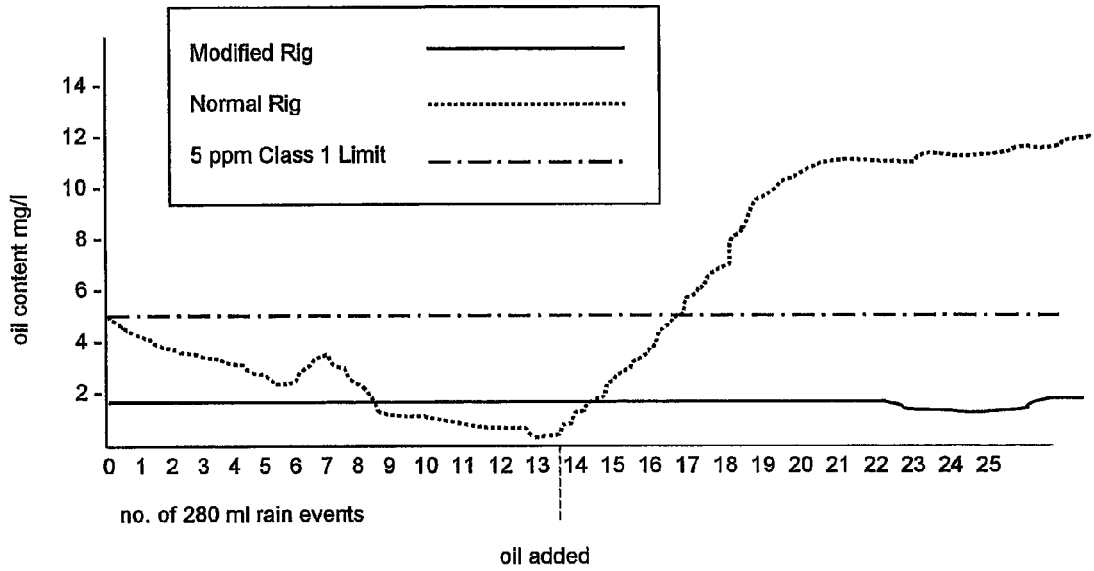
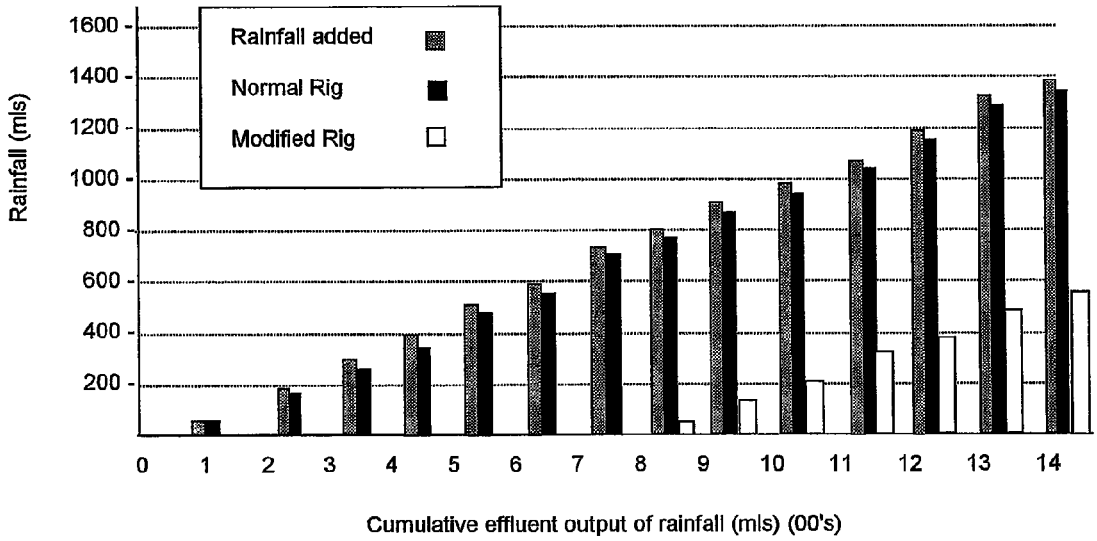
Figure 7

PAVING SYSTEM

This invention relates to a paving system of the type having an upper pervious layer over a substrate which can hold floodwater or e.g. chemical spillage.

GB-2 294 077-A discloses a paving system having a plurality of layers comprising an upper layer permeable to liquid, such as a perforated pavement, a substrate layer of hard, load bearing particulate material and an impermeable layer. Flood water or chemical spillage which passes through the upper layer is held by the interstitial spaces between the nodules of particulate material. It is stated that some of the nodules can be porous or hollow to hold bacteria for use in the biological decomposition of spillage. A feature of this system is that it requires the use of the impermeable layer so that water and spillages can be held in the substrate layer.

Viewed from one aspect, the present invention provides a paving system comprising an upper layer permeable to liquid, and a substrate layer of load bearing particulate material, wherein particles of a non-load bearing, porous, liquid retentive material are distributed in the interstitial spaces between particles of the load bearing particulate material.

Viewed from another aspect, the present invention provides a method of constructing a paving system comprising the steps of laying down a substrate layer of load bearing particulate material, distributing particles of a non-load bearing, porous, liquid retentive material in the interstitial spaces between the load bearing particulate material, and laying above the substrate layer an upper layer permeable to liquid.

In accordance with the invention, the porous liquid retentive material absorbs water or liquid spillage which passes through the upper layer. By this means, it is possible to retain a considerable volume of liquid within the structure. In certain embodiments of the invention, therefore, it is possible to dispense with an impermeable layer of the type disclosed in GB-2 294 077-A and the system is in fluid communication with the surrounding soil, either at least partly directly and/or at least partly through a permeable membrane such as a geotextile. However, the invention can also be used in such a system to enhance its performance.

It is a requirement of the substrate in GB-2 294 077-A that the material is non-friable, i.e. that it cannot be crumbled easily, and in general that holds also for the load bearing substrate of the present invention. However, it is not necessary for the interstitial liquid retentive material to be non-friable. Indeed, in one embodiment the liquid retentive material is deliberately chosen so as to be readily friable, as this provides a convenient means of constructing the paving system. Thus, a layer of load bearing particulate material is laid down, and then a layer of the porous liquid retentive material. This is then subjected to compression, either directly using a tool, and/or indirectly by placing a further layer of load bearing material on it. The readily friable material crumbles into smaller particles, and these then settle down into the interstitial spaces between the load bearing particles. An advantage of this method is that the liquid retentive material can be transported and handled in convenient sized pieces rather than the small particles which eventually occupy the interstitial spaces in the substrate layer. Thus, whilst the liquid retentive material may be supplied as relatively small particles, such as chips, suitable for occupying the interstitial spaces between the particulate material, in a preferred embodiment the material is supplied in larger pieces, smaller particles being created during use on site.

Typically, in use and occupying the interstitial spaces, the liquid retentive material has a mass per unit area density of between about 1 to about 3.5 kg/m$^2$, more preferably about 2.5 to about 3.5 kg/m$^2$ and typically about 3 kg/m$^2$ depending upon site conditions and local climatic conditions. Before being placed on top of the substrate layer and crumbled, the material may be supplied in blocks, chips or other units of volumes such as, for example, about 5 mm to about 10 mm cubes, about 5 to about 10 mm spheres, or irregular shapes of about 5 mm to about 30 mm average diameter. The foam can also be applied in larger blocks or sheets as desired (e.g. with dimensions greater than about 0.5 m).

Thus, viewed from another aspect, the present invention provides a method of constructing a paving system comprising the steps of laying down a substrate layer of load bearing particulate material, laying down a friable, non-load bearing porous liquid retentive material on the substrate layer, subjecting the liquid retentive material to force so that it crumbles into particles which settle into the interstitial spaces between the load bearing particulate material of the substrate layer, and laying above the substrate layer an upper layer permeable to liquid.

In an alternative method for providing a paving system in accordance with aspects of the invention, there are laid down discrete substrate layer units, each comprising a slab or block comprising load bearing particulate material bonded together by a non-load bearing porous liquid retentive material. By subjecting the a layer of such units, or multiple layers of such units, to force, the structure of the units will break up so that the load bearing particulate material forms a substrate layer, with the load bearing particles in contact with each other, and portions of the liquid retentive material in the interstitial spaces between the load bearing particulate material of the substrate layer.

Thus, viewed from another aspect the present invention provides a method of constructing a paving system comprising the steps of laying down discrete substrate layer units, each comprising load-bearing particulate material bonded together by a non-load bearing porous liquid retentive material; subjecting the units to force so that the structure of the units is altered to provide a load bearing substrate layer of the load bearing particulate material, with the load bearing particles in contact with each other and portions of the liquid retentive material in the interstitial spaces between the load bearing particulate material of the substrate layer; and laying above the substrate layer an upper layer permeable to liquid.

To facilitate deployment of the units, taking into account the non-load bearing nature of the liquid retentive material, they may be provided in frames, crates or other containers or the like to maintain structural integrity until they are positioned and then subjected to force. The frames or the like may be of plastic, cardboard or another suitable material, and may be sacrificial, biodegradable or the like.

Crates or the like could also be used for the deployment of loose load bearing particulate material with particles of the non-load bearing, porous, liquid retentive material already distributed in the interstitial spaces between particles of the load bearing particulate material, or simply present in larger blocks to be broken up. Of course the two materials could be laid down in bulk already mixed in this form.

Thus, viewed from another aspect, the present invention provides a method of constructing a paving system comprising the steps of laying down a substrate layer of load bearing particulate material, having distributed therein particles of a non-load bearing, porous, liquid retentive material in the interstitial spaces between the load bearing particulate material, and laying above the substrate layer an upper layer permeable to liquid. In one embodiment, the load bearing particulate material, having distributed therein particles of the non-load bearing, porous, material is laid down in discrete units in containers.

Viewed from another aspect, the present invention provides a method of constructing a paving system comprising the steps of laying down a substrate layer of load bearing particulate material provided with portions of a friable, non-load bearing porous liquid retentive material, subjecting the liquid retentive material to force so that it crumbles into particles which settle into the interstitial spaces between the load bearing particulate material of the substrate layer, and laying above the substrate layer an upper layer permeable to liquid. In one embodiment, the load bearing particulate material, provided with portions of the non-load bearing, porous, material is laid down in discrete units in containers.

The liquid retentive material for use in accordance with the various aspects of the invention is porous so that it can absorb water and other liquids, or microorganisms for use in the biological decomposition of spillages such as oil. The material should also be such that it undergoes little or no expansion when it absorbs water or other liquids, as expansion within the substrate layer could lead to damage or instability of the paving system. The material should be non-biodegradable. The liquid retentive material is preferably relatively solid but friable, rather than being easily compressible such as a sponge-like foam. In preferred embodiments, the liquid retentive material has a cellular structure with an average pore size (i.e. cross sectional area) in the range of about 1200 to about 10000 $\mu m^2$, preferably about 1500 to about 4000 or about 4500 $\mu m^2$, and typically an average pore size of around 4000 to 4225 $\mu m^2$.

Preferably, the liquid retentive material is a porous foamed polymeric material. A preferred foamed material is an open celled phenolyic foam, for example made from phenol formaldehyde resin, such as that marketed by Smithers-Oasis under the trade mark OASIS™ which is used principally as floral foam into which flower stems can be pushed. This type of foam has been classified for disposal in landfill sites in the UK. It is inert, does not biodegrade over time, does not expand and has minimal mechanical strength, so that it crumbles under load. The OASIS™ foam is made from phenol formaldehyde resins which are reacted with an acid catalyst to be cured, and hydrocarbons are added to make the resin expand. The final product, typically in the form of a brick has no hydrocarbons present, and has slight acidity with everything else inert. The potential for water retention and other qualities is a function of the material's pore size. The pore size is related to the density of the foam produced at the manufacturing stage. For example, the current range of OASIS™ products available for general flower arranging purposes includes these three densities:—

- Premium Foam: about 21 to about 23 $kg/m^3$ density gives the best water retention due to it greater volume of cells within the structure.
- Ideal Foam: about 19 $kg/m^3$ to about 21 $kg/m^3$ and good water retention.
- Classic Foam: just below 19 $kg/m^3$ and good water retention.

A typical foam material for use in accordance with the invention can preferably hold between about 40 to 50 times its own mass in water, for example one gram of the foam can retain between about 40 and about 50 ml of water and in a preferred embodiment of the invention about fifty times its own mass. These figures are for the material before use in situ. In a preferred embodiment, the compressed material between the interstitial spaces preferably holds between about 20 to 50 times its own mass of water, more preferably between about 40 and 50 times, and typically between about fifteen and about twenty times its own mass of water.

Oil degrading microbial communities are produced by the association between oil, nutrients, water and substrates bearing microbial spores. In essence, the factors needed for the biodegradation of oil can be provided in a conventional design in accordance with GB-2 294 077-A. However, a system in accordance with the present invention features the ability to store and more fully decontaminate water to a far greater degree. The key areas in the improvement are the time given for extensive treatment and the surface area on which to grow microbes. The preferred average pore size of will permit micro organisms to penetrate the interior of the material. This size of pores is large enough to allow bacteria, fungi, protozoa and metazoa to enter.

In practice, with a given average pore size there may be considerable variation in the pore sizes. It is possible that this difference in sizes would allow certain microbes to penetrate more easily than others. Restriction of some organisms from the interior of the foam may produce a variety of microbial communities thus allowing a refuge from predator organisms and maintenance of an oil degrading community. The highly porous structure will also allow the system to remain aerated and allow evaporation of the stored water, preventing the production of anaerobic conditions and stagnant water.

There may be a "flushing" effect when water is added to the foam, where water is continually forced out of the bottom of the material by new water infiltrated at the surface. Due to the capacity for water storage inherent in the preferred foam, water bearing dissolved oil would be given a long period for treatment before being released. If water added to the foam is not in excess of the storage capacity then approximately 100% can be retained. Since soluble oil is more easily degraded than free product, this relatively low concentration will be in close contact with areas of bio-film accumulation growing on the interior of the material. This can be used to achieve to achieving a concentration of <5 ppm.

Thus, the available surface area of the interior of the preferred foam allows the growth of a diverse and abundant microbial community. The hydrological characteristics of the material permit the storage of substantial masses of water and the time needed for the biodegradation of soluble oil fractions not immobilised by a geotextile as in a system in accordance with GB-2 294 077-A. Thus the effects of the invention on the hydrological, chemical and microbiological characteristics of a permeable paving system can be considerable, leading to the provision of an attractive low cost option for the management of storm water quality and quantity.

It will be appreciated that the expression "paving" is intended to be of wide scope and is not restricted to a system with an upper layer formed of paving stones, blocks, slabs or other paving elements. Thus, whilst the upper layer is preferably formed of a plurality of individual paving elements, the upper layer may also be of other materials such as tarmac, provided that arrangements are made for liquid to permeate through to the underlying layers. The invention is applicable to roads, runways, refueling stations, chemical loading bays, vehicle parks and other areas on which vehicles are driven, as well as to pavements and pedestrian areas.

In a preferred arrangement, there is provided a pavement system comprising the upper layer permeable to liquid, the substrate layer of load bearing particulate material, which is relatively coarse with the particles of foamed polymeric material are distributed in the interstitial spaces, and an intermediate layer between the upper and substrate layers, which is of load bearing relatively fine particulate material. The intermediate layer could be of e.g. gravel or crushed gravel.

The intermediate layer provides a flat surface for paving slabs or the like, and also helps to disperse fluid passing through the upper layer. The intermediate layer is preferably of a material which is not readily friable, dissolved or susceptible to frost damage, and is substantially inert to water. The average particle size is preferably a maximum of about 15 mm (and is preferably in the range of about 5 mm to about 10 mm, and there may be a considerable variation in individual particle size within this range.

Beneath the intermediate layer, there may be a layer of a geotextile material. Such materials are well known and are used as a soil reinforcement agent and as a filter medium, often used in road construction. Typically a geotextile is made of synthetic fibres manufactured in a woven or loose non-woven manner to form a blanket-like product. The material should be non-biodegradable.

The substrate layer of relatively coarse particles may be of crushed stone, pebbles, or blast furnace slag for example. The material should also be preferably of a material which is not readily friable, dissolved or susceptible to frost damage, and is substantially inert to water. The average particle size is preferably up to a maximum of about 100 mm maximum dimension) and is preferably in the range of about 15 mm to about 100 mm, preferably up to about 50 mm to about 100 mm, and there may be a considerable variation in individual particle size within this range. However, preferably, the majority of particles are in the lower to mid end of this range, for example up to about 80, 60 or 40 mm.

A system in accordance with the invention may be used in a system as disclosed in GB-2 294 077-A, with an impermeable layer underneath and even surrounding the lower layers. However, it can be used also without such a layer in view of the enhanced water retention. Preferably, though, a permeable geotextile bottom layer is provided to assist in retaining the elements of the system, although this is not essential.

The upper layer may be permeable by virtue of the material used, or by the provision of apertures or, in the case of individual paving elements, by spaces between the elements. Such spaces may be filled with a permeable material.

In general, the preferred foam material used in a system in accordance with the invention may be used in a number of sub-surface applications, whether or not the upper layer is pervious, where there is a need to absorb liquids. Thus in general there is provided a sub-surface system within a region of earth, rock or the like, provided with load bearing regions interspersed with regions of non-degradable porous foamed polymeric material for retaining liquid. The regions of porous material could be dispersed in the interstitial spaces of a particulate load bearing region, and in a preferred arrangement there is provided a system having the features described earlier.

In arrangements using containers in which material is laid down, the containers may provide the functions of permeable or impermeable membranes retaining the material, depending on the desired application, and a separate permeable or non-permeable membrane underneath and/or to the sides of the material may not be required.

Some embodiments of the invention will now be described by way of example and with reference to the accompanying drawings, in which.

Figure 4A:
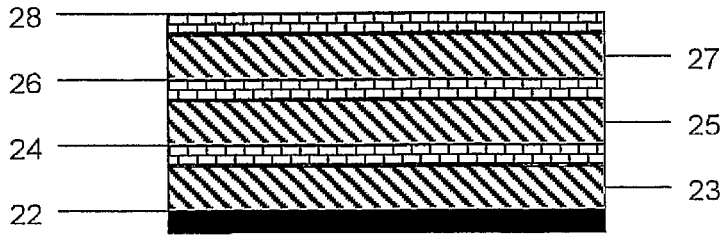
Figure 4B:
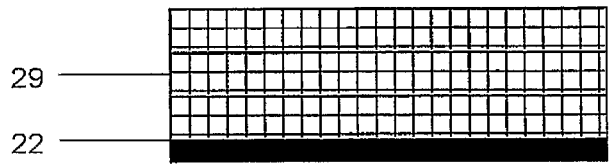
Figure 5:
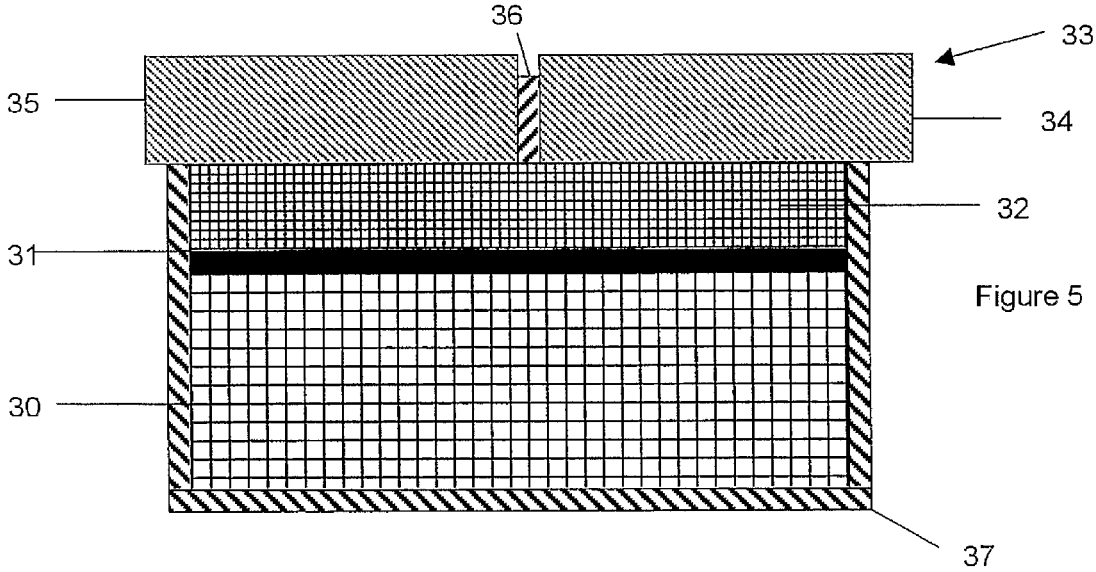
Figure 8:
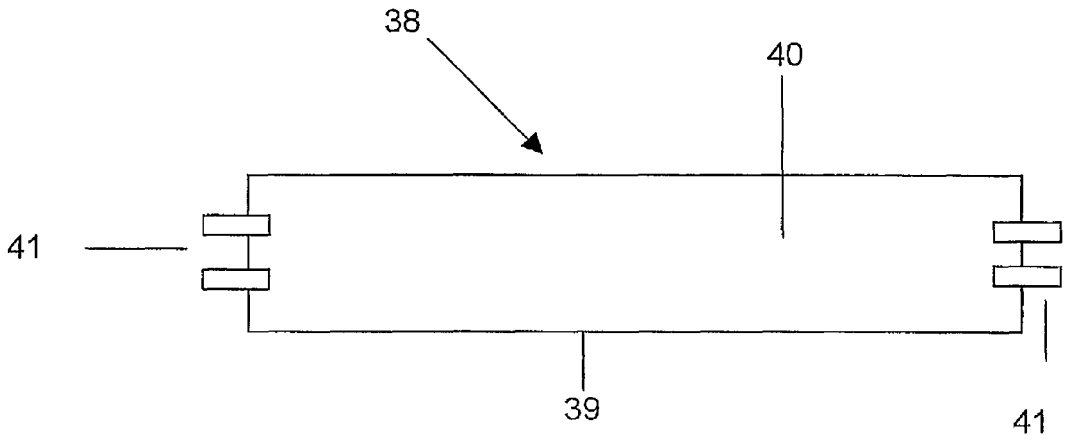
Figure 9:
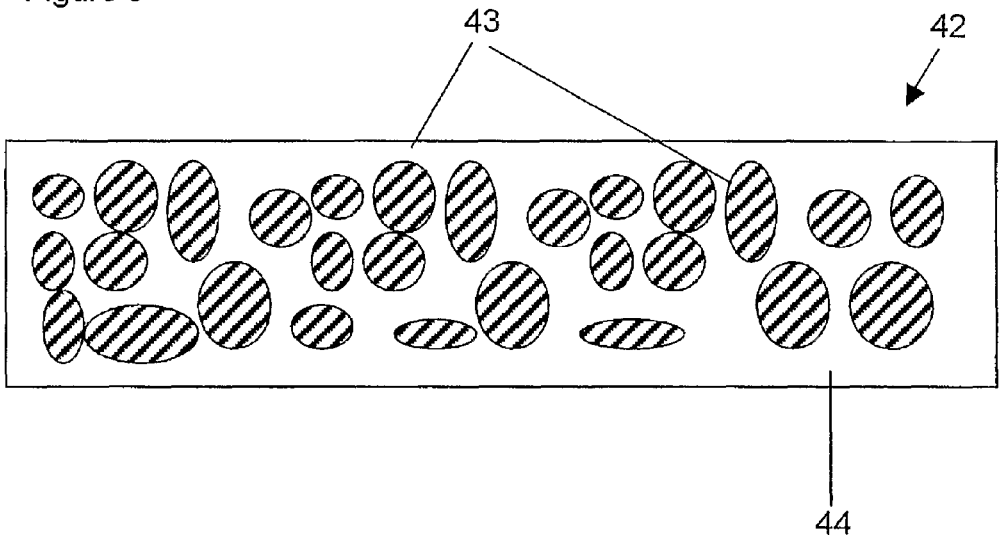

FIGS. 3*a* to 3*f* are view showing stages in the construction of a system in accordance with the invention;

FIGS. 4*a* and 4*b* show two stages in alternative method of constructing a system in accordance with the invention;

FIG. 5 is a view of an alternative system in accordance with the invention;

FIG. 6 is a graph showing a comparison between a system in accordance with the invention and a known system;

FIG. 7 is a graph comparing outputs related to cumulative rainfall for a system in accordance with the invention and a known system;

FIG. 8 is a diagram showing a container for use in alternative embodiments of the invention; and FIG. 9 is a diagrammatic cross section through material provided in such a container in one embodiment.

Figure 1:
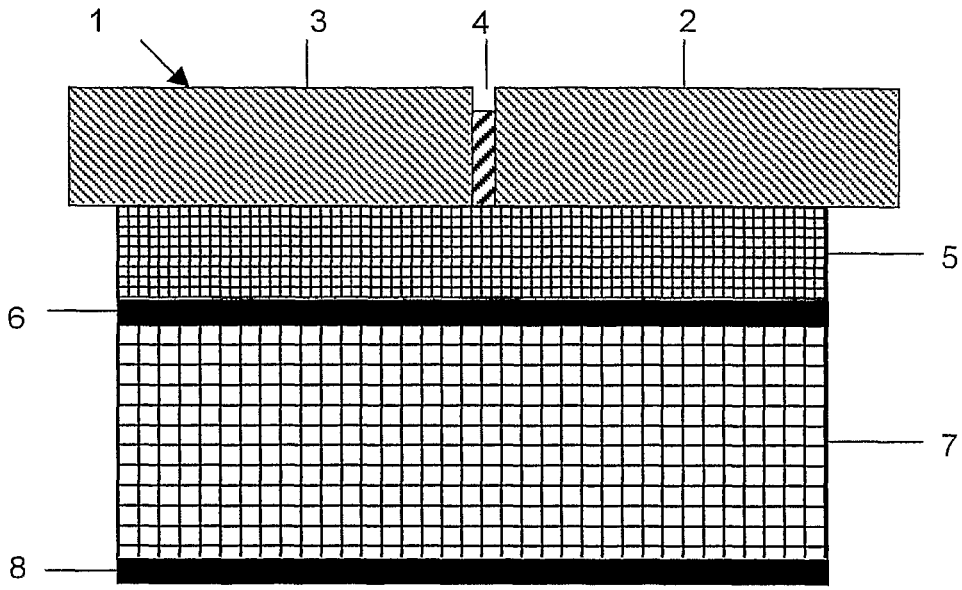
FIG. 1 is a section through part of a paving system in accordance with the invention.

Referring now to FIG. 1, there is shown a paving system with an upper paving layer 1, comprising a number of concrete paving slabs 2 and 3. In this case, the slabs are impermeable but they are separated by gaps 4 which can be filled with sand or another suitable permeable material. Alternatively, the slabs could be provided with apertures such as slots to allow liquid to pass to the layers below, or could be made from a pervious material. The slabs are load bearing and need to take the weight of traffic, people and so forth. Beneath the paving layer 1 is a permeable intermediate layer 5 of relatively fine gravel, and beneath that is a permeable geotextile layer 6. Beneath that is a main substrate layer 7 and beneath that is a further permeable geotextile layer 8. The system is installed in the ground.

Figure 2:
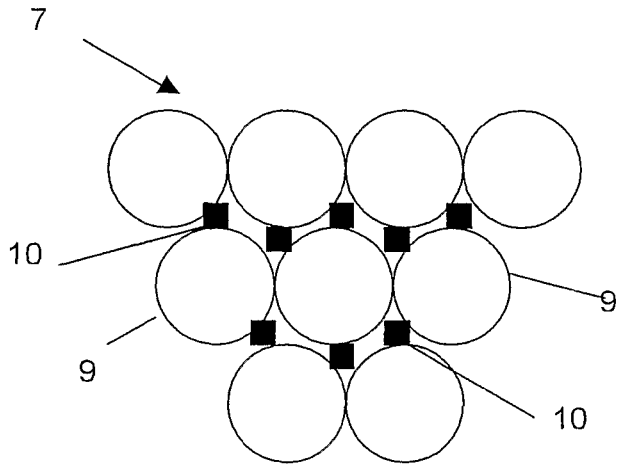
FIG. 2 is a schematic view of part of the main substrate layer of the system of FIG. 1.

As shown diagrammatically in FIG. 2, the substrate layer 7 comprises relatively coarse particles 9 of crushed stone or the like, with relatively small particles of a porous material 10 interspersed in the interstices between the particles. The porous material in this case is a foamed phenol formaldehyde resin, such as that marketed by Smithers-Oasis under the trade mark OASIS™ as discussed earlier.

Figure 3A:
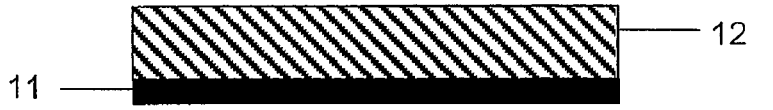
Figure 3B:
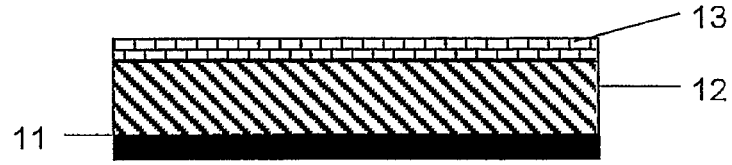
Figure 3C:
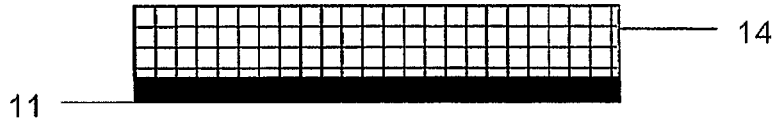
Figure 3D:
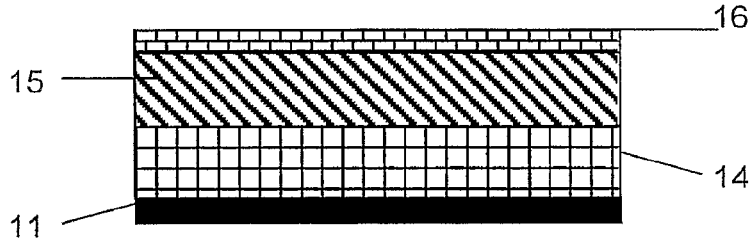
Figure 3E:
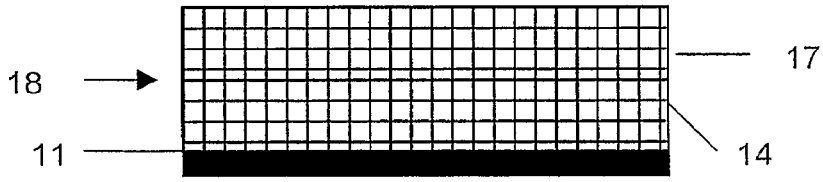
Figure 3F:
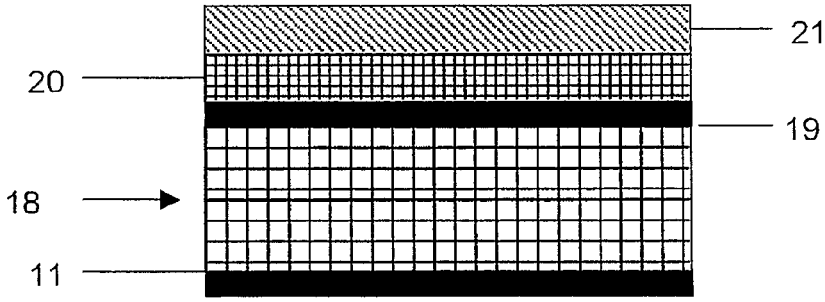

FIGS. 3*a* to 3*f* show various stages in the construction of a paving system such as that of FIGS. 1 and 2. In FIG. 3*a*, in a first step a main substrate layer 12 is laid on a permeable geotextile layer 11. In FIG. 3*b*, a layer 13 of blocks or lumps of the foamed porous material is laid on top of the main substrate layer 12. The layer 13 is then subjected to a force using a suitable tool, so that being readily friable it crumbles into small particles which settle down into the main substrate layer 12, to create the combined layer 14 as shown in FIG. 3*c*, whose construction is as described with reference to FIGS. 1 and 2. A second main substrate layer 15 is the laid on top of this, followed by a second layer 16 of blocks of the foamed material. This is subjected to force as before, so create a second substrate layer 17 on top of the first substrate layer 14, as shown in FIG. 3*e*, so as to create a complete substrate layer 18. As shown in FIG. 3*f*, this is then covered by a geotextile layer 19, an intermediate layer 20 of relatively fine crushed gravel or the like, and a paving layer 21 of a suitable paving material. The paving layer 21 is pervious. It will be appreciated that by repeating the steps, substrate layer 18 can be formed from as many separate layers as desired.

An alternative manner of construction is shown in FIGS. 4*a* and 4*b*. In this method, a permeable geotextile layer 22 is laid down, followed by layers 23, 25 and 27 of relatively coarse particulate material to form the substrate layer, alternating with layers 24, 26 and 28 of blocks of the foamed material discussed above. The entire construction is then subjected to a load from above, using a suitable tool. The blocks in the layers 24, 36 and 28 crumble and relatively fine particles settle into the layers 23, 25 and 27, to form the complete substrate layer 29 as shown in FIG. 4*b*.

FIG. 5 shows an alternative construction. This is similar generally to the system of FIGS. 1 and 2. There is a main substrate layer 30 of relatively coarse particulate material with interstitial relatively fine particles of the porous foamed material. Then there is a permeable geotextile layer 31, an intermediate layer 32, and a pervious paving layer 33 comprising paving slabs 34 and 35 separated by sand 36. Instead of the lower geotextile layer, the entire structure below the paving layer is surrounded by an impermeable layer 37. In this arrangement, the system operates in a manner similar to that of GB-2 294 077-A, but with improved water retention and improved ability to retain and bio-degrade oil spillages for example.

A conventional system in accordance with GB-2 294 077-A has a drawback in that it is able to store only small amounts of water. Infiltration devices are available to trap and treat hydrocarbons, but it is difficult to prevent hydrocarbon infiltration into effluent as certain oil fractions are readily soluble in water. The capture of mobile pollutants can be difficult as rainfall duration and velocity can be highly unpredictable. A system in accordance with the invention, even without the use of an impermeable surrounding layer, is much more efficient at the entrapment and attenuation of low level hydrocarbons and can exceed the standard of <5 ppm for the discharge of oil.

A system in accordance with the invention can dry out readily, so that in non-rainfall conditions the system can carry out pollutant degradation activities and prepare itself for the next rain event. In experiments it has been found impossible to saturate fully the preferred OASIS™ foam material, so that there will be flow attenuation even in seriously inclement conditions.

The average pore size of the preferred material is large enough to allow microorganisms to inhabit the interior of the material. Under appropriate nutrient conditions, the biofilm produced can remove soluble pollutants from the effluent, providing the concentration of <5 ppm, below the concentration required for a class 1 interception device. The hydrological characteristics of the preferred foam provide the necessary holding time for the biodegradation to take place. A conventional system in accordance with GB-2 294 077-A may only be able to meet the standards of a class 2 interception device.

In a test, using a standard system in accordance with GB-2 294 077-A, and a system in accordance with the present invention substantially as described with reference to FIGS. 1 and 2, oil content in the effluent was measured over the course of twenty four 280 ml rain events. When oil was added after twelve events, there was a rapid rise in oil content in the effluent using the standard system, to well above the 5 ppm class 1 limit. Using a system in accordance with the present invention, the oil level in the effluent remained consistently well below the limit. FIG. 6 is a graph showing the oil in effluent plotted against a number of 280 ml rain events, with the "Modified Rig" being a system in accordance with the invention, and the "Normal Rig" being a system in accordance with GB-2 294 077-A.

In a further test, the standard system and the system in accordance with the invention were tested for the water holding capacity. Over a period of approximately one hour, 100 ml increments of water were added every five minutes to give a total of 1200 ml. This equates to 3.9 times the London average weekly rainfall for 0.121 $m^2$ of pavement with each 100 ml event. The total added was 46.8 times the total weekly London rainfall, added in one hour. Only after six rainfall events, 23.4 times the London average weekly rainfall, was a significant volume of effluent collected from the system in accordance with the invention. It then remained well below one third to one half. FIG. 7 is a chart comparing the results, again with the "Modified Rig" being a system in accordance with the invention, and the "Normal Rig" being a system in accordance with GB-2 294 077-A. The results were obtained using 20 g of OASIS™ foam, giving rise to a theoretical water holding capacity of 8.26 liters of water per $m^2$ as the OASIS™ foam holds around 50 times its own mass of water when uncrushed. In the test, the oil loading was 17.8 g $m^{-2}$, one hundred times that dropped on the average urban payment of 178 mg $m^{-2}$ per week. Even fully compressed, the preferred foam material should hold 13 times its mass in terms of water retention.

A system in accordance with preferred embodiments of the invention avoids the use of expensive materials such as hydrodynamic separators and additional ground preparation or equipment. The systems are capable of trapping not only hydrocarbons but also mobile pollutants such as pesticides. A very large surface area is provided for the growth of biofilms and the degradation of pollutants. The microscopic cell like structure of the preferred foam allows organisms to penetrate and feed on pollutants.

Alternative foams or indeed other materials may be used. As regards foamed materials, Table 1 below compares various foamed materials with phenol formaldehyde, the preferred material used in embodiments of the invention.

TABLE 1

| Plastic Foam | Density kg/$m^3$ | Thermal Resistance 1-in. Specimens,** Kelvin meter/watt (ASTM C-177) | Coeff Thermal Exp, $10^{-5}$/° f. (ASTM D-696) | Water Vapour Transmission, perm-cm. (ASTM C-355) | Water Absorption (short term), % by vol (ASTM D-2127) | Compressive Strength at 10% Deflection, kgf/cm2 (ASTM D-1621) | Max Continuous Service Temp,*** ° C. |
|---|---|---|---|---|---|---|---|
| Polyurethane**** And Polyisocyanurate Foams | 24-48 | 41-62 | 3-8 | 5-8 | <0.1-2.0 | 1.05-4.21 | 100 |
| Phenol-formaldehyde (Foamed-in-place) | 18-80 | 27-34 | 0.5 | 25-228 | 1.0-4.0 at 50% RH 13-51 at 100% RH | 1.54-6 | 148 |
| Urea-formaldehyde (Carbamide-formaldehyde) | 12-21 | 34-41 | — | 76-254 | Very high | 0.35 | 49 |
| Epoxy (Sprayed or foamed-in-place) | 28-36 | 48-62 | — | — | — | 1-1.83 | 71-93 |

**Thermal resistance is for 21° C. mean temperature.

***The values given are for the dry material; the values for wet foams are usually much lower.

****Foamed with halocarbon.

Although the polyurethane foams do not have particularly good water retention properties they can be modified so as to increase the water retaining capabilities. Thus, polyurethane derivatives may be suitable for use in systems in accordance with the invention. It may also be possible to improve the water retention properties to polyurethane foams by having a closed cell structure. Indeed, in general foams used in systems according to the invention can be open or closed cellular structured within the foams, but primarily the optimum used would be open celled. Modifications to foams so that they can perform the same or similar functions of the preferred foams, are within the scope of the invention.

There is also on the market a cross-linked polyacrylamide, which is a crystal like structure that absorbs 500 times its own mass in water. It is possible that this could be used in a system in accordance with the invention although it suffers from expansion and bio-degradability problems over time. Also on the market there is another compound that has good water absorbing properties called sodium polyacrylate. It is not foam, and more like a desiccant.

FIG. 8 shows a rectangular plastics container 38, in the form of a crate with a base 39 and retaining walls 40, which can be used to lay down discrete units of the load bearing material and the porous foamed material already combined. Interlocking clips 41 are provided so that the crates can be interlocked in an array.

FIG. 9 shows a cross section through a composite material 42 which can be provided in the crate of FIG. 8. Particles of a load bearing substance 43, such as crushed stone, are provided in the composite material and are held together by a foamed material 44 such as the OASIS™ foam described above, which has acted like a cement as it has set. When the composite material 42 is subjected to load, the crushed stone particles take up a load bearing configuration, whilst the foam breaks up to form particles occupying the interstitial spaces. A substrate layer is thus formed, for use in a paving system such as that of FIG. 1. The base 39 of the crate may serve the purpose of the permeable geotextile layer 8 of FIG. 1, or may be provided with apertures so that liquid can pass through to a separate layer 8 as in FIG. 1. However, in this particular embodiment, the plastics crates used remain in place but are sacrificed when the structure is loaded, breaking into pieces.

A paving system in accordance with the invention may be incorporated in any type of paved area, including a walkway, roadway, patio, piazza and so forth.

The invention may be viewed from a number of additional aspects, including a paving system comprising an upper layer permeable to liquid, and a substrate layer of load bearing particulate material, wherein particles of a non-load bearing, porous material are distributed in the interstitial spaces between particles of the load bearing particulate material; a paved area comprising such a paving system; a method of constructing a paving system comprising the steps of laying down a substrate layer of load bearing particulate material, distributing particles of a non-load bearing, porous material in the interstitial spaces between the load bearing particulate material, and laying above the substrate layer an upper layer permeable to liquid; a method of constructing a paving system comprising the steps of laying down a substrate layer of load bearing particulate material, laying down a friable, non-load bearing porous liquid retentive material on the substrate layer, subjecting the liquid retentive material to force so that it crumbles into particles which settle into the interstitial spaces between the load bearing particulate material of the substrate layer, and laying above the substrate layer an upper layer permeable to liquid; and paved area comprising a paving system constructed in accordance with such methods.

The invention claimed is:

1. A paving system comprising an upper paved layer permeable to water, and a substrate layer of load bearing particulate material, wherein particles of a non-load bearing, highly porous, water retentive foamed polymeric material are distributed in the interstitial spaces between particles of the load bearing particulate material, the particles of water retentive material storing substantial masses of water in the substrate layer.

2. A paving system as claimed in claim 1, wherein the porous foamed polymeric material is such as to undergo little or no expansion when it absorbs liquids and is non-biodegradable.

3. A paving system as claimed in claim 1 wherein the porous foamed polymeric material is readily friable.

4. A paving system as claimed in claim 1, wherein the porous foamed polymeric material has a cellular structure.

5. A paving system as claimed in claim 4, wherein the porous foamed polymeric material is an open celled phenolyic foam.

6. A paving system as claimed in claim 5, wherein the phenolyic foam is made from a phenol formaldehyde resin which has been reacted with an acid catalyst to be cured, and to which a hydrocarbons has been added to make the resin expand.

7. A paving system as claimed in claim 1, wherein the water retentive material is provided with microorganisms for the biodegradation of pollutants.

8. A paving system as claimed in claim 1, wherein the system is in fluid communication with surrounding soil.

9. A paving system as claimed in claim 8, wherein the system is in fluid communication with the surrounding soil at least partly through a permeable membrane.

10. A paving system as claimed in claim 1, wherein an intermediate load bearing layer is provided between the upper layer and the substrate layer, the intermediate layer being of a particulate material which is finer than the load bearing particulate material of the substrate layer.

11. A paving system as claimed in claim 10, wherein a permeable membrane is provided between the intermediate layer and the substrate layer.

12. A paving system as claimed in claim 1, wherein the upper paved layer is formed of a plurality of individual paving elements and water permeable gaps are provided between adjacent paving elements.

13. A paving system as claimed in claim 1, wherein the water retentive material retains between thirteen and fifty times its own mass of water.

14. A method of constructing a paving system comprising the steps of laying down a substrate layer of non-friable load bearing particulate material, distributing particles of a non-load bearing, highly porous, water retentive foamed polymeric material in the interstitial spaces between the load bearing particulate material, and laying above the substrate layer an upper paved layer permeable to water, the particles of water retentive material storing substantial masses of water in the substrate layer.

15. A method as claimed in claim 14, wherein the water retentive material retains between thirteen and fifty times its own mass of water.

16. A method of constructing a paving system comprising the steps of laying down a substrate layer of non-friable load bearing particulate material, laying down a readily friable, non-load bearing highly porous water retentive foamed polymeric material on the substrate layer, subjecting the water retentive foamed polymeric material to force so that it crumbles into particles which settle into the interstitial spaces between the load bearing particulate material of the substrate layer, and laying above the substrate layer an upper paved layer permeable to water, the particles of water retentive material storing substantial masses of water in the substrate layer.

17. A method as claimed in claim 16, wherein alternating layers of the load bearing particulate material, and the readily friable, non-load bearing highly porous foamed polymeric material are laid down.

18. A method as claimed in claim 16, wherein the water retentive material retains between thirteen and fifty times its own mass of water.

19. A method of constructing a paving system comprising the steps of laying down discrete substrate layer units, each comprising load bearing particulate material and a non-load bearing highly porous water retentive foamed polymeric material; subjecting the units to force so that the structure of the units is altered to provide a load bearing substrate layer of the load bearing particulate material, with the load bearing particles in contact with each other and portions of the water retentive material in the interstitial spaces between the load bearing particulate material of the substrate layer; and laying above the substrate layer an upper paved layer permeable to water, the portions of water retentive material storing substantial masses of water in the substrate layer.

20. A method as claimed in claim 19, wherein the discrete units are provided with supporting containers in which they are laid down.

21. A method as claimed in claim 19, wherein the water retentive material retains between thirteen and fifty times its own mass of water.

22. A method as claimed in claim 20, wherein the containers are sacrificial.

23. A method as claimed in claim 20, wherein the containers provide the function of an impermeable membrane.

24. A method as claimed in claim 20, wherein the containers provide the function of a permeable membrane.

25. A paved area for supporting vehicles or pedestrians, comprising an upper paved layer having an upper surface, and a sub-surface system which supports the upper layer, wherein the sub-surface system comprises non-friable load bearing portions between which are interspersed non-load bearing portions of a non-degradable, water retentive highly porous foamed polymeric material for storing substantial masses of water which has permeated to the sub-surface system from the upper surface of the upper layer.

26. An area as claimed in claim 25, wherein the foamed polymeric material has a cellular structure.

27. An area as claimed in claim 26, wherein the foamed polymeric material is an open celled phenolyic foam.

28. An area as claimed in claim 27 wherein the phenolyic foam is made from a phenol formaldehyde resin which has been reacted with an acid catalyst to be cured, and to which a hydrocarbons has been added to make the resin expand.

29. An area as claimed in claim 25, wherein the foamed polymeric material is provided with microorganisms for the biodegradation of pollutants.

30. An area as claimed in claim 25, wherein the foamed polymeric material is readily friable.

31. An area as claimed in claim 25, wherein the upper layer is formed from discrete paving elements.

32. An area as claimed in claim 25, wherein the upper layer is tarmac.

33. A paved area as claimed in claim 25, wherein the water retentive material retains between thirteen and fifty times its own mass of water.

34. A paving system comprising an upper paved layer permeable to water, and a substrate layer of load bearing particulate material, wherein particles of a non-load bearing, highly porous, water retentive foamed polymeric material are distributed in the interstitial spaces between particles of the load bearing particulate material, the particles of water retentive material storing substantial masses of water in the substrate layer and each particle retaining between thirteen and fifty times its own mass of water.

* * * * *